US007367657B2

(12) United States Patent
Lee et al.

(10) Patent No.: US 7,367,657 B2
(45) Date of Patent: May 6, 2008

(54) INKJET PRINTHEAD WITH TRANSISTOR DRIVER

(75) Inventors: Francis Chee-Shuen Lee, Hsinchu (TW); Jui-Hua Hu, Taiping (TW); Jia-Lin Chen, Hsinchu (TW); Wei-Fu Lai, Taichung (TW)

(73) Assignee: International United Technology Co., Ltd., Hsin-Chu (TW)

( * ) Notice: Subject to any disclaimer, the term of this patent is extended or adjusted under 35 U.S.C. 154(b) by 379 days.

(21) Appl. No.: 11/180,759

(22) Filed: Jul. 12, 2005

(65) Prior Publication Data

US 2006/0238576 A1 Oct. 26, 2006

(30) Foreign Application Priority Data

Apr. 25, 2005 (TW) ..... 94113065 A

(51) Int. Cl.
*B41J 2/05* (2006.01)

(52) U.S. Cl. ..... 347/64; 347/58

(58) Field of Classification Search ..... 347/56–59, 347/62–65, 67
See application file for complete search history.

(56) References Cited

U.S. PATENT DOCUMENTS 5,122,812 A * 6/1992 Hess et al. ..... 347/59
5,159,353 A 10/1992 Fasen et al. ..... 347/59
5,742,307 A * 4/1998 Watrobski et al. ..... 347/62
5,774,148 A 6/1998 Cornell et al. ..... 347/59
6,132,030 A 10/2000 Cornell ..... 347/57
6,132,032 A 10/2000 Bryant et al. ..... 347/59
6,213,587 B1 * 4/2001 Whitman ..... 347/65
6,234,612 B1 5/2001 Cornell et al. ..... 347/62
6,391,527 B2 5/2002 Yagi et al. ..... 430/313
6,450,622 B1 9/2002 Nguyen et al. ..... 347/63
6,523,935 B2 2/2003 Torgerson et al. ..... 347/40
6,676,246 B1 1/2004 Anderson et al. ..... 347/62
6,726,311 B2 4/2004 Torgerson et al. ..... 347/55
6,800,497 B2 10/2004 Wang et al. ..... 438/21
7,267,430 B2 * 9/2007 Parish ..... 347/59

* cited by examiner

*Primary Examiner*—Juanita D. Stephens
(74) *Attorney, Agent, or Firm*—J.C. Patents

(57) ABSTRACT

An inkjet printhead chip includes a substrate, transistors, isolation structures, a dielectric layer, a resistive layer and conductive sections. Each transistor includes a gate, a source, a drain and a gate oxide disposed between the gate and the substrate. The isolation structures are on the substrate surface and isolate the transistors. The dielectric layer covers the transistors and the isolation structures, and has openings exposed the source and the drain. Several heating regions are in the resistive layer that is on the dielectric layer. In the conductive sections, the first conductive section is on the resistive layer and exposes the heating regions for forming several heating devices. Each heating device has resistance less than 95 ohm and power density less than 2 $GW/m^2$; the second conductive section and the third conductive section are electrically coupled to the drain and the source through the openings of the dielectric layer respectively.

48 Claims, 5 Drawing Sheets

INKJET PRINTHEAD WITH TRANSISTOR DRIVER

CROSS-REFERENCE TO RELATED APPLICATION

This application claims the priority benefit of Taiwan application serial no. 94113065, filed on Apr. 25, 2005. All disclosure of the Taiwan application is incorporated herein by reference.

BACKGROUND OF THE INVENTION

1. Field of Invention

The present invention relates to an inkjet printhead chip. More particularly, the present invention relates to an inkjet printhead chip with transistor drivers.

2. Description of Related Art

With the rapid development in the electronic industry, many high-tech products are produced in recent years. In particular, there is a major revolution in the design of printers, from the pin-activated and monochromatic laser printing to color inkjet and color laser printing. The two major methods used by a conventional inkjet printer for producing ink jets are the piezoelectric and thermal bubble techniques. One major aspect of the techniques is to target jets of ink onto a recording medium such as a paper so that words, images, or patterns are formed on the surface of the recording medium. In the piezoelectric jetting technique, the actuator is a piezoelectric material layer. When a voltage is applied to the piezoelectric material, the piezoelectric layer deforms to pressurize the ink within an ink chamber so that a jet of ink is forced out from the ink chamber via an ink nozzle. In the thermal bubble jetting technique, a small quantity of ink is rapidly vaporized by a heater (resistor) to generate a sudden increase of pressure in the ink so that a droplet of ink is squeezed out from an ink chamber via an ink nozzle.

FIG. 1 is a plan view, schematically illustrating a conventional inkjet printhead. Referring to FIG. 1, the conventional inkjet printhead mainly has an inkjet printhead chip 100 with an ink supply slot 102, a chamber layer (also called dry film layer) 104, a heating device (heater) 106 and a nozzle plate 110 with nozzle 108. The ink supply slot 102 has an elongated shape (but can also be in other shapes such as an elliptical or circular shape) and is formed through the entire inkjet printhead chip 100. The heating device 106 and the chamber layer 104 are formed over the inkjet printhead chip 100. The chamber layer 104 usually has a plurality of ink flow channels 112 and an ink chambers 120 (only one of them is shown in FIG. 1). The ink chamber 120 exposes the heating device 106 and communicates with the ink supply slot 102 via the ink flow channels 112 separated optionally by separators 114. The nozzle plate 110 is positioned above the chamber layer 104 and has a plurality of nozzles (only one of them is shown in FIG. 1). The nozzle 108 of the nozzle plate 110 is formed through the entire thickness of the nozzle plate 110, and is positioned above the corresponding heating device 106.

In addition, the drivers and heating devices are integrated onto the inkjet printhead chip in some inkjet cartridges or printers. However, how to reduce the area of the chip while maintaining its performance has been one of the issues considered by the persons skilled in the art.

SUMMARY OF THE INVENTION

Accordingly, the present invention is to provide an inkjet printhead chip to increase the drive current and reduce the usable area of the inkjet printhead chip.

Another objective of the present invention is to provide an inkjet printhead chip to reduce the cost and prevent error operation of the chip.

Other objectives, features and advantages of the present invention will be further understood from the further technology features disclosed by the present invention wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

Based on one, some or all of the aforementioned objects or other objects, the present invention provides an inkjet printhead chip, including a substrate, a plurality of transistors, an isolation structure, a dielectric layer, a resistive layer and a plurality of conductor sections. Each transistor includes a gate disposed on the substrate, a source and a drain disposed in the substrate at the two sides of the gate respectively, and a gate oxide layer disposed between the gate and the substrate, wherein the thickness of the gate oxide layer is less than 800 Å. The isolation structure is disposed on the surface of the substrate and isolates each transistor, and the dielectric layer covers over the transistor and the isolation structure. The dielectric layer has a plurality of openings which expose the source and the drain of each transistor. The resistive layer is disposed on the dielectric layer and has a plurality of heating areas. The first conductor section of the conductor sections is disposed on the resistive layer and exposes the heating area thereof so as to form the heating device. The resistance of each heating devices is less than 95 ohm, and the power density is less than 2 $GW/m^2$ (gigawatt/$m^2$). The second conductor section disposed over the dielectric layer is electronically coupled to the drain via the opening. The second conductor section is electronically coupled to the first conductor section. The third conductor section disposed over the dielectric layer is electrically coupled to the source via the opening.

In the inkjet printhead chip according to one of the embodiments of the present invention, the thickness of the gate oxide layer is about 50 Å-250 Å.

In the inkjet printhead chip according to one of the embodiments of the present invention, the resistance of the heating device is between about 28 ohm and about 32 ohm.

The inkjet printhead chip according to one of the embodiments of the present invention, further includes a passivation layer which covers the resistive layer and conductor sections; and the cavitation layer disposed on the passivation layer above the heating area. The passivation layer includes SiN layer, SiC layer or a stack layer of SiN layer and SiC layer. The material of the cavitation layer may include Ta, W or Mo.

In the inkjet printhead chip according to one of the embodiments of the present invention, the resistive layer further includes a part extending between the second conductor section and each opening surface of the dielectric layer.

In the inkjet printhead chip according to one of the embodiments of the present invention, the resistive layer further includes a part disposed between the third conductor section and each opening surface of dielectric layer.

In the inkjet printhead chip according to one of the embodiments of the present invention, the aspect ratio of the heating device is between 0.8 and 3.0, and the length of each heating device is between 20 microns and 70 microns, and the width is between 20 microns and 70 microns.

In the inkjet printhead chip according to one of the embodiments of the present invention, the material of the conductor sections includes AlCu or Au, while the material of the resistive layer includes TaAl, TaN or doped polysilicon. The isolation structure includes a field oxide layer.

In the inkjet printhead chip according to one of the embodiments of the present invention, the number of the heating devices is at least 50.

The present invention also provides an inkjet printhead chip, including a substrate, a plurality of transistors, an isolation structure, a sandwich structured dielectric layer, a resistive layer and a plurality of conductor sections. Each transistor includes a gate disposed on the substrate, a source and a drain disposed in the substrate at the two sides of the gate respectively, and a gate oxide layer disposed between the gate and the substrate, wherein the thickness of the gate oxide layer is less than 800 Å. The isolation structure disposed on the surface of the substrate isolates each transistor. The sandwich structured dielectric layer comprises two barrier layers and one planar layer disposed between the two barrier layers and covers the transistor and the isolation structure. The sandwich structured dielectric layer has a plurality of openings which expose the source and the drain of each transistor. Moreover, the resistive layer disposed over the sandwich structured dielectric layer has a plurality of heating areas. The first conductor section is disposed over the resistive layer and exposes the heating area thereof so as to form the heating device. The second conductor section is disposed over the sandwich structured dielectric layer and is electronically coupled to the drain via the opening. The second conductor section is electronically coupled to the first conductor section and the third conductor section is disposed over the sandwich structured dielectric layer and is electrically coupled to the source via the opening.

In the inkjet printhead chip according to another embodiment of the present invention, the material of the planar layer of the sandwich structured dielectric layer includes phosphosilicate glass (PSG) or borophosphosilicate glass (BPSG), and the thickness of the planar layer is about 0.09 microns-1.4 microns.

In the inkjet printhead chip according to another embodiment of the present invention, the sandwich structured dielectric layer may include barrier layers made of material such as plasma-enhanced oxide (PEOX) or low pressure oxide (LPOX) and planar layer made of material such as PSG or BPSG. The thickness of the planar layer is about 0.09 microns-1.4 microns, while the thickness of each barrier layer is about 0.09 microns-0.33 microns.

The present invention also provides an inkjet printhead chip, including a substrate, a plurality of transistor circuits and a plurality of film layers. The transistor circuits are disposed on the substrate, and each transistor circuit includes a gate oxide layer with thickness less than 800 Å. The film layers are formed on the transistor circuits, wherein the film layers include a resistive layer which forms a plurality of heating devices. The heating device is electronically coupled to the corresponding transistor circuit. A power density less than 2 $GW/m^2$ can be obtained in the heating device by supplying current to each heating device, wherein the resistance of each heating device is less than about 95 ohm.

In the inkjet printhead chip according to another embodiment of the present invention, the film layers include a sandwich structured dielectric layer, wherein the sandwich structured dielectric layer comprises two barrier layers and a planar layer disposed between the two barrier layers.

In the inkjet printhead chip according to another embodiment of the present invention, the material of the planar layer of the sandwich structured dielectric layer includes PSG or BPSG, and the thickness thereof is about 0.09 microns-1.4 microns.

In the inkjet printhead chip according to another embodiment of the present invention, the sandwich structured dielectric layer may include barrier layers made of material such as PEOX or LPOX and planar layer made of material such as PSG or BPSG, and the thickness of the planar layer is about 0.09 microns-1.4 microns, while the thickness of each barrier layer is about 0.09 microns-0.33 microns.

Since the thickness of the gate oxide layer is less than 800 Å, the present invention can obtain larger electric field than that by using the conventional technology when applying the same voltage. Therefore, the saturation current (Isat) of the inkjet printhead chip according to present invention is also larger, so that the larger current can be driven. Meanwhile, with the same channel length, the resistance of the conducted unit area is smaller, so that the smaller layout area for a transistor can be used to obtain the same driving capability as the conventional art. Therefore, the usable area of the inkjet printhead chip can be reduced, which in turn the manufacturing cost can be reduced. Moreover, the sandwich structured dielectric layer according to one embodiment of the present invention can maintain the planar surface of the device while it can prevent impurities in the planar layer from affecting the structures disposed below and above the sandwich structured dielectric layer.

DESCRIPTION OF EMBODIMENTS

Figure 1:
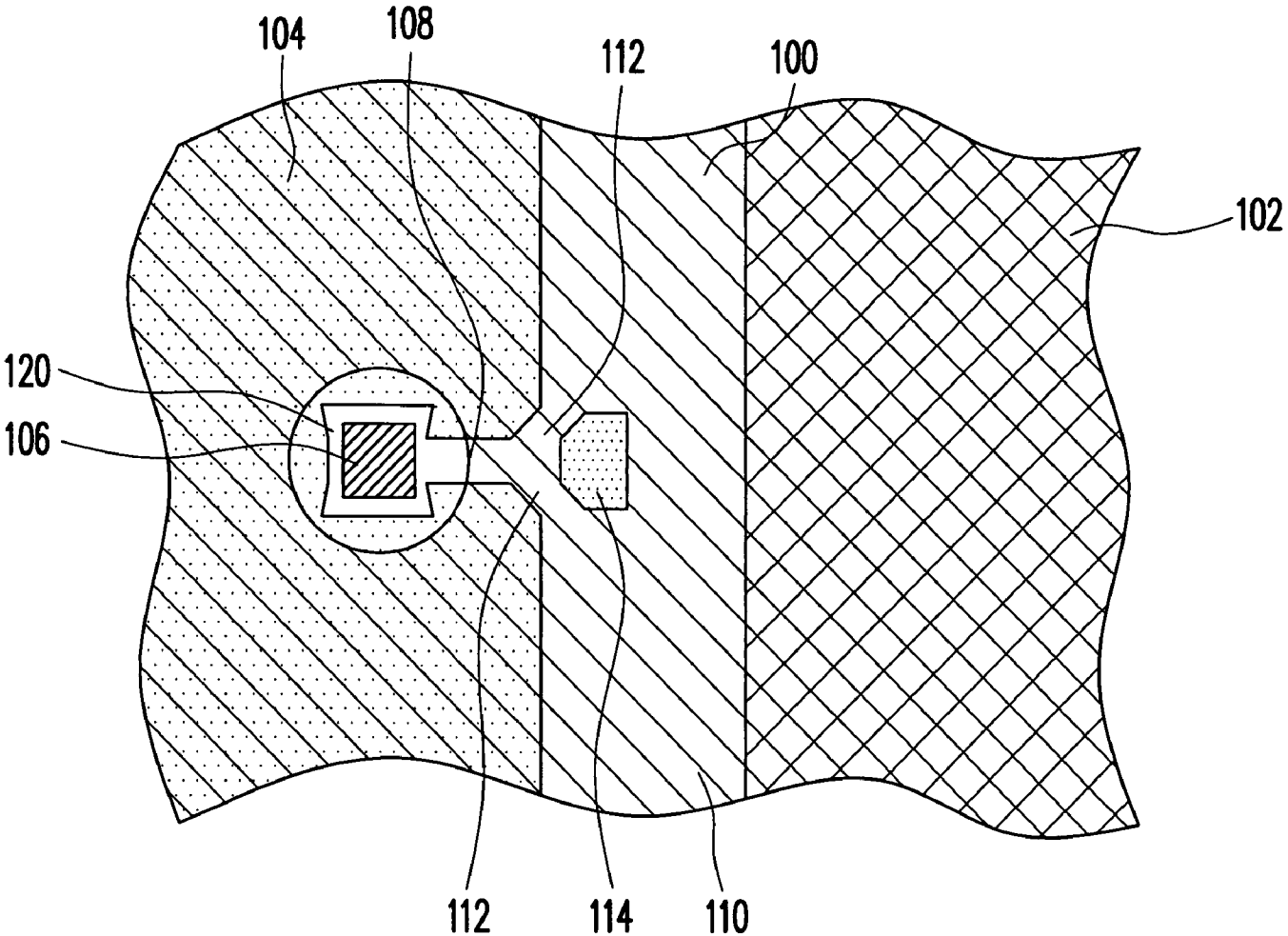
FIG. 1 (PRIOR ART)
FIG. 1 is a top view, schematically illustrating a structure of a conventional inkjet printhead.
Figure 2:
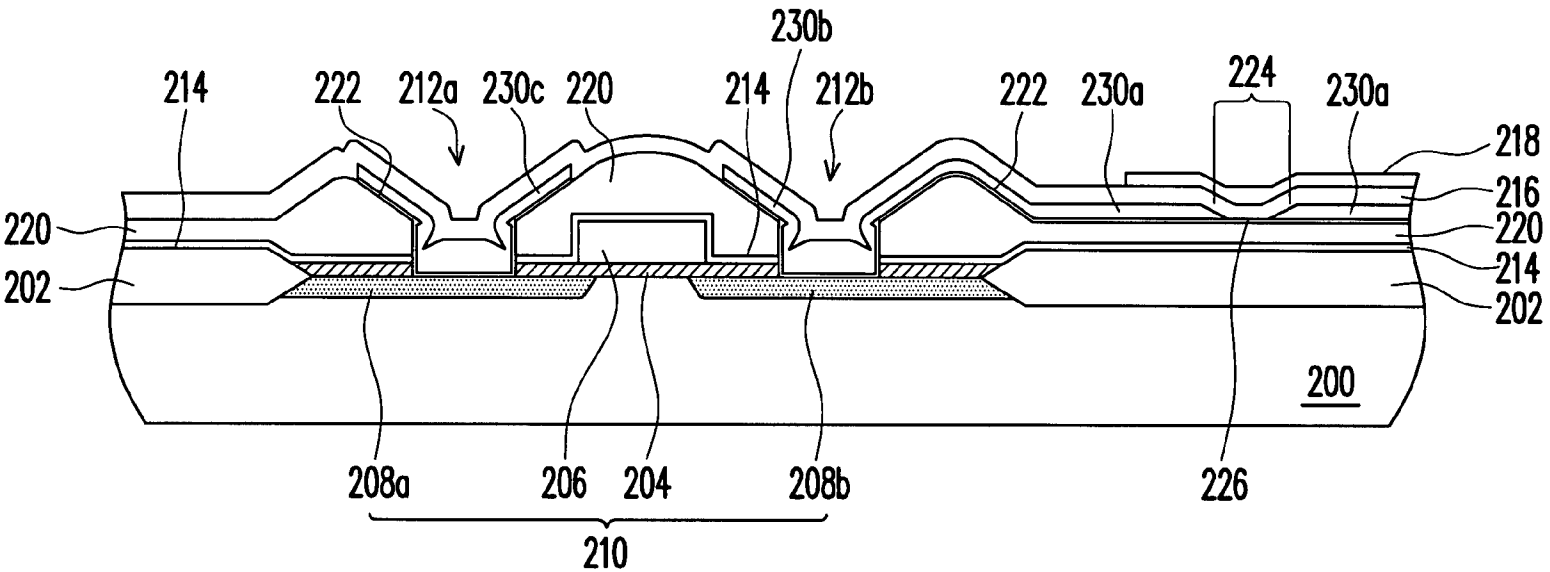
FIG. 2 is a cross-sectional view, schematically illustrating an inkjet printhead chip according to the first embodiment of the present invention.

FIG. 2 is a cross-sectional view, schematically illustrating an inkjet printhead chip according to the first embodiment of the present invention.

In FIG. 2, the inkjet printhead chip according to the embodiment includes a substrate 200, a transistor 210, an isolation structure 202, a dielectric layer 220, a resistive layer 222 and a plurality of conductor sections 230*a*, 230*b* and 230*c*. The transistor 210 includes a gate 206 disposed on the substrate 200, a source 208*a* and a drain 208*b* disposed in the substrate 200 at the two sides of the gate 206 respectively, and the gate oxide layer 204 disposed between the gate 206 and the substrate 200. The thickness of the gate oxide layer 204 is less than 800 Å, and the preferred thickness is about 50 Å-250 Å, while the further preferred thickness is about 100 Å-200 Å. As a result, the present invention can obtain a larger electric field than that by using the conventional technology when applying the same voltage. In such a situation, the saturation current (Isat) is also larger, so that the larger current can be driven. Meanwhile, with the same channel length, the resistance of the conducted unit area is smaller, so that the smaller layout area for a transistor can be used to obtain the same driving capability as the conventional art. Therefore, the usable area of the inkjet printhead chip can be reduced, which in turn the manufacturing cost can be reduced. The gate oxide layer 204 can be formed by furnace or by a chemical vapor deposition process. The gate oxide layer 204 can also be made of high K material.

In FIG. 2, the isolation structure 202 in the embodiment can be, for example, field oxide layer, and is disposed on the surface of the substrate 200 to isolate each transistor 210. The dielectric layer 220 covers the transistor 210 and the isolation structure 202. The dielectric layer 220 has a plurality of openings 212*a* and 212*b* which expose the source 208*a* and the drain 208*b* of the transistor 210. Moreover, an oxide layer 214 can be added between the dielectric layer 220 and the transistor 210 (including the gate 206, the source 208*a* and the drain 208*b*). The resistive layer 222 is disposed on the dielectric layer 220 and has a plurality of heating areas 224. The material of the resistive layer 222 includes, for example, TaAl, TaN or doped polysilicon, or other materials known by those skilled in the art that can be used in heating devices (heaters) of a inkjet printhead.

Still referring to FIG. 2, there are three conductor sections 230*a*, 230*b* and 230*c*. The material of the conductor sections 230*a*, 230*b* and 230*c* includes AlCu or Au. The first conductor section 230*a* is disposed on the resistive layer 222 above the isolation structure 202 and exposes the heating area 224 of the resistive layer 222 so as to form the heating device 226. The resistance of each heating device 226 is less than 95 ohm, and the power density is less than 2 $GW/m^2$. The preferred resistance of the heating device 226 is about between 28 ohm and 32 ohm, and the preferred power density is less than or about equal to 1.85 $GW/m^2$ (the power density in the present invention is the average power that the surface of the heating device receives in the period from the time when the printer or printing device begins to supply voltage to the heating device to heat the ink and then vaporize the ink to be jetted out from the corresponding ink chamber, to the time that the printer or printing device stops to supply voltage to the heating device). The aspect ratio of the heating device 226 (the ratio of length over width of the heating device) is, for example, between 0.8 and 3.0, and the preferred aspect ratio is between 0.8 and 2.5, and the length of each heating device 226 is between 20 microns and 70 microns, and the width is between 20 microns and 70 microns, while the preferred length is between 30 microns and 50 microns and the preferred width is between 30 microns and 50 microns. Although there are only one transistor 210 and one heating device 226 shown in FIG. 2, the number of the heating devices 226 in one inkjet printhead chip is usually at least 50, for example, about 192-208, while the present invention is not limited to this number. The invention just requires that there is a specific relation between the transistor 210 and the heating device 226, such as one transistor electrically coupled to one heating device as shown in FIG. 2.

In addition, please continue to refer to FIG. 2, the second conductor section 230*b* is disposed over the dielectric layer 220 and is electronically coupled to the drain 208*b* via the opening 212*b*. The second conductor section 230*b* is electronically coupled to the first conductor section 230*a*. The resistive layer 222 can also extend between the second conductor section 230*b* and the surface of the opening 212*b* of the dielectric layer 220. The third conductor section 230*c* is also disposed over the dielectric layer 220 and is electronically coupled to the source 208*a* via the opening 212*a*. The resistive layer 222 can also extend between the third conductor section 230*c* and the surfaces of the opening 212*a* of the dielectric layer 220. The first conductor section 230*a* and the second conductor section 230*b* may belong to the same conductor layer, while the third conductor section 230*c* is another conductor layer. In one embodiment, the second conductor section 230*b* and the third conductor section 230*c* may belong to the same conductor layer, while the first conductor section 230*a* is another conductor layer; In another embodiment, the first conductor section 230*a* and the third conductor section 230*c* may belong to the same conductor layer, while the second conductor section 230*b* is another conductor layer. In further another embodiment, the first conductor section 230*a*, the second conductor section 230*b* and the third conductor section 230*c* may be three different conductor layers. Of course, the first conductor section 230*a*, the second conductor section 230*b* and the third conductor section 230*c* can be the three sections defined in the same conductor layer.

Moreover, still referring to FIG. 2, the inkjet printhead chip according to the embodiment may further includes a passivation layer 216 used to prevent the ink from corroding the underlying structure layers, wherein the passivation layer 216 covers the resistive layer 222 and conductor sections 230*a*, 230*b* and 230*c*. The passivation layer 216 includes, for example, SiN layer, SiC layer or the stack of SiN layer and SiC layer. The thickness of the passivation layer 216 is about 3375 Å-8250 Å, and the preferred thickness of the passivation layer 216 is about 6750 Å-8250 Å. If the passivation layer is the stack layer of SiN and SiC, the thickness of the SiN layer is about 2250 Å-5500 Å, and the preferred thickness of SiN layer is about 4500 Å-5500 Å, while the thickness of SiC layer is about 1125 Å-2750 Å and the preferred thickness of SiC layer is about 2250 Å-2750 Å. There can be a cavitation layer 218 positioned on the passivation layer 216, wherein the material of the cavitation layer 218 may include Ta, W or Mo, and the thickness is about 2475 Å-6050 Å while the preferred thickness is about 4950 Å-6050 Å. However, it shall be noted if the passivation layer 216 or the cavitation layer 218 is used in the present invention, the thickness is not limited to the abovementioned value.

Figure 3:
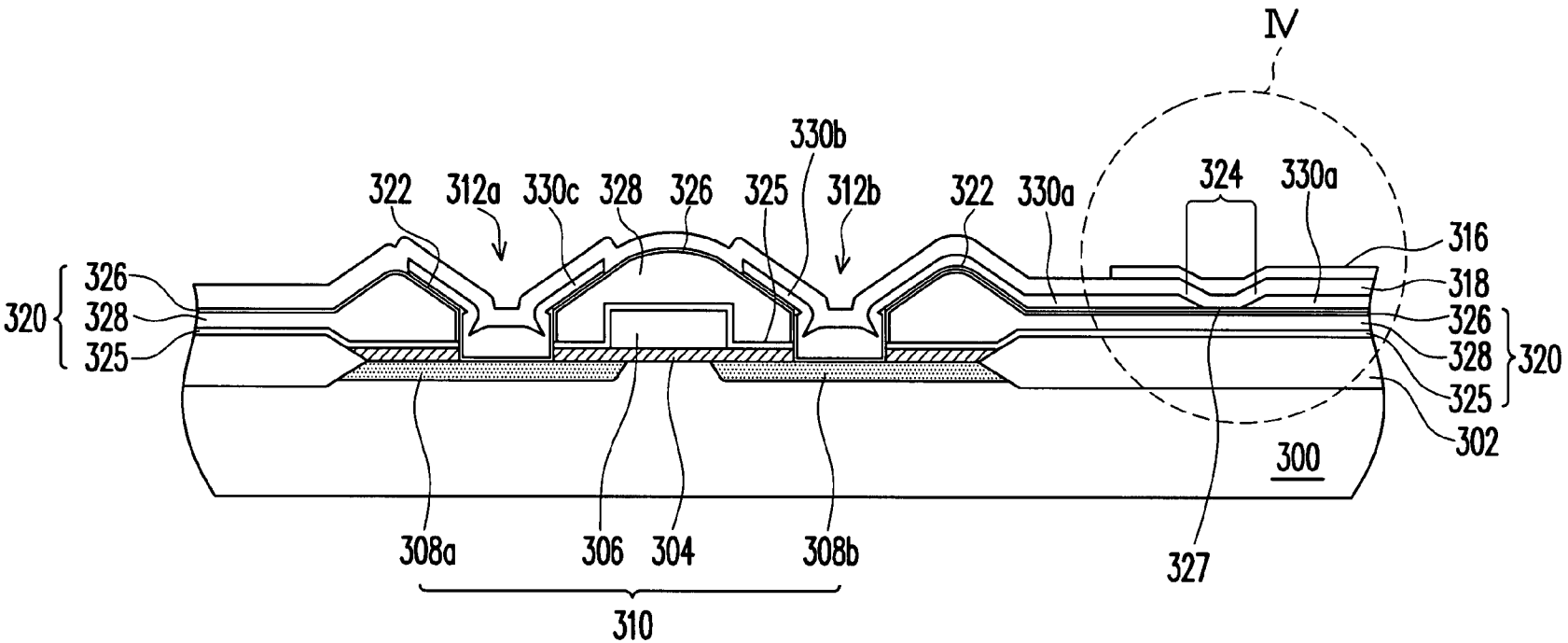
FIG. 3 is a cross-sectional view, schematically illustrating an inkjet printhead chip according to the second embodiment of the present invention.
Figure 4:
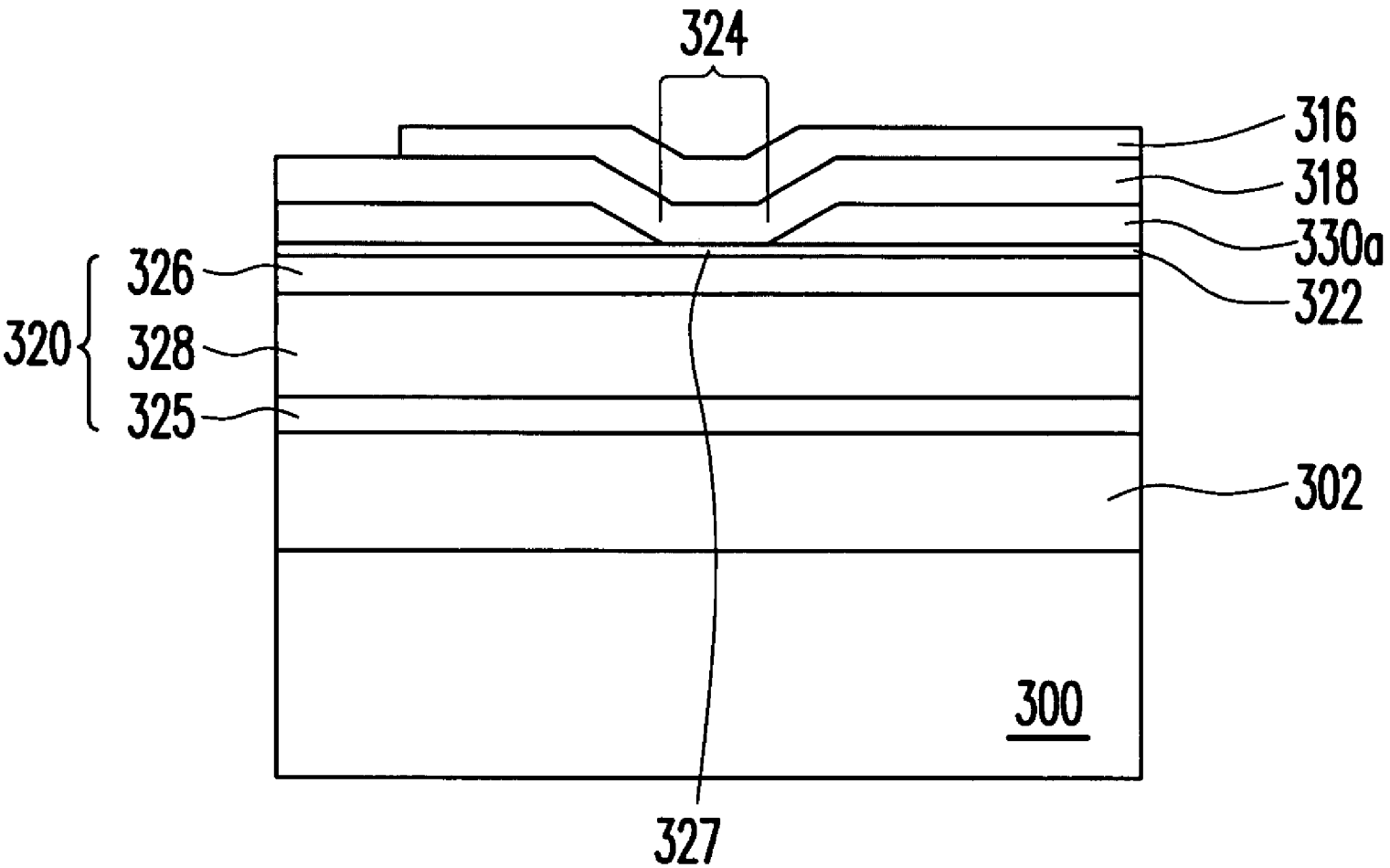
FIG. 4 is an enlarged schematic diagram of the part IV in FIG. 3.

FIG. 3 is a cross-sectional view, schematically illustrating an inkjet printhead chip according to the second embodiment of the present invention. FIG. 4 is an enlarged schematic diagram of the part IV in FIG. 3.

Referring to FIG. 3 and FIG. 4, the inkjet printhead chip according to the embodiment includes a substrate 300, a transistor 310, an isolation structure 302, a dielectric layer 320 having a sandwich structure (i.e. sandwich structured dielectric layer), a resistive layer 322 and a plurality of conductor sections 330*a*, 330*b* and 330*c*. The transistor 310 includes a gate 306 disposed on the substrate 300, a source 308*a* and a drain 308*b* disposed in the substrate 300 at the two sides of the gate 306 respectively, and a gate oxide layer 304 disposed between the gate 306 and the substrate 300. The thickness of the gate oxide layer 304 is less than 800 Å, while the preferred thickness is less than about 250 Å and the further preferred thickness is between about 150 Å and about 200 Å. Moreover, the isolation structure 302 is disposed on the surface of the substrate 300 and isolates the transistor 310. The sandwich structured dielectric layer 320 comprises two barrier layers 325, 326 and one planar layer 328 disposed between the two barrier layers, and covers the transistor 310 and the isolation structure 302. The sandwich structured dielectric layer 320 has a plurality of openings 312*a* and 312*b* which expose the source 308*a* and drain 308*b* of the transistor 310. Moreover, in one example, the material of the planar layer 328 of the sandwich structured dielectric layer 320 includes, for example, phosphosilicate glass (PSG) or borophosphosilicate glass (BPSG), and the thickness thereof is about 0.09 microns-1.4 microns, while the preferred thickness is 0.45 microns-0.55 microns. In another example, the material of the barrier layers 325, 326 includes, for example, plasma-enhanced oxide (PEOX) or low pressure oxide (LPOX), while the material of the planar layer 328 includes, for example, PSG or BPSG, wherein, the thickness of individual barrier layer 325, 326 is about 0.09 microns-0.33 microns and the preferred thickness is about 0.09 microns-0.11 microns, while the thickness of the planar layer 328 is about 0.09 microns-1.4 microns and the preferred thickness is about 0.45 microns-0.55 microns. Because impurities in the planar layer 328 can be blocked by the above/below barrier layers 325, 326, the gate 306, the source 308*a* and the drain 308*b* disposed below the sandwich structured dielectric layer 320 will not be affected by the impurities, and the layer, for example, the resistive layer 322, disposed above the sandwich structured dielectric layer 320 will not be harmed or affected by the impurities.

Still referring to FIG. 3 and FIG. 4, the resistive layer 322 is disposed on the sandwich structured dielectric layer 320 and has a plurality of heating areas 324. The first conductor section 330*a* of the conductor sections 330*a*, 330*b* and 330*c* is disposed on the resistive layer 322 above the isolation structure 302 and exposes the heating area 324 of the resistive layer 322 to form the heating device 327, and the number of the heating devices 327 is usually at least 50, for example, about 192-208, but the present invention is not limited to this number. The second conductor section 330*b* is disposed over the sandwich structured dielectric layer 320 and is electronically coupled to the drain 308*b* via the opening 312*b*, and the second conductor section 330*b* is electronically coupled to the first conductor section 330*a*. The third conductor section 330*c* is also disposed over the sandwich structured dielectric layer 320 and is electrically coupled to the source 308*a* via the opening 312*a*. Similarly to the first embodiment, the first conductor section 330*a* and the second conductor section 330*b* may belong to the same conductor layer, while the third conductor section 330*c* is another conductor layer; or, the second conductor section 330*b* and the third conductor section 330*c* may belong to the same conductor layer, while the first conductor section 330*a* is another conductor layer; or, the first conductor section 330*a* and the third conductor section 330*c* may belong to the same conductor layer, while the second conductor section 330*b* is another conductor layer. The first conductor section 330*a*, the second conductor 330*b* and the third conductor 330*c* may belong to three different conductor layers. Of course, the first conductor section 330*a*, the second conductor section 330*b* and the third conductor section 330*c* can be the three parts defined by the same conductor layer. Moreover, the inkjet printhead chip according to this embodiment may further include a passivation layer 316 which covers the resistive layer 322 and conductor sections 330*a*, 330*b* and 330*c*, and a cavitation layer 318 disposed on the passivation layer 316 above the heating area 324. The structures and film layers that are the same as the first embodiment can be made of the same as or similar materials and sizes to those in the first embodiment. For example, the resistive of each heating device 327 is less than 95 ohm and the power density is less than 2 GW/m$^2$.

Figure 5:
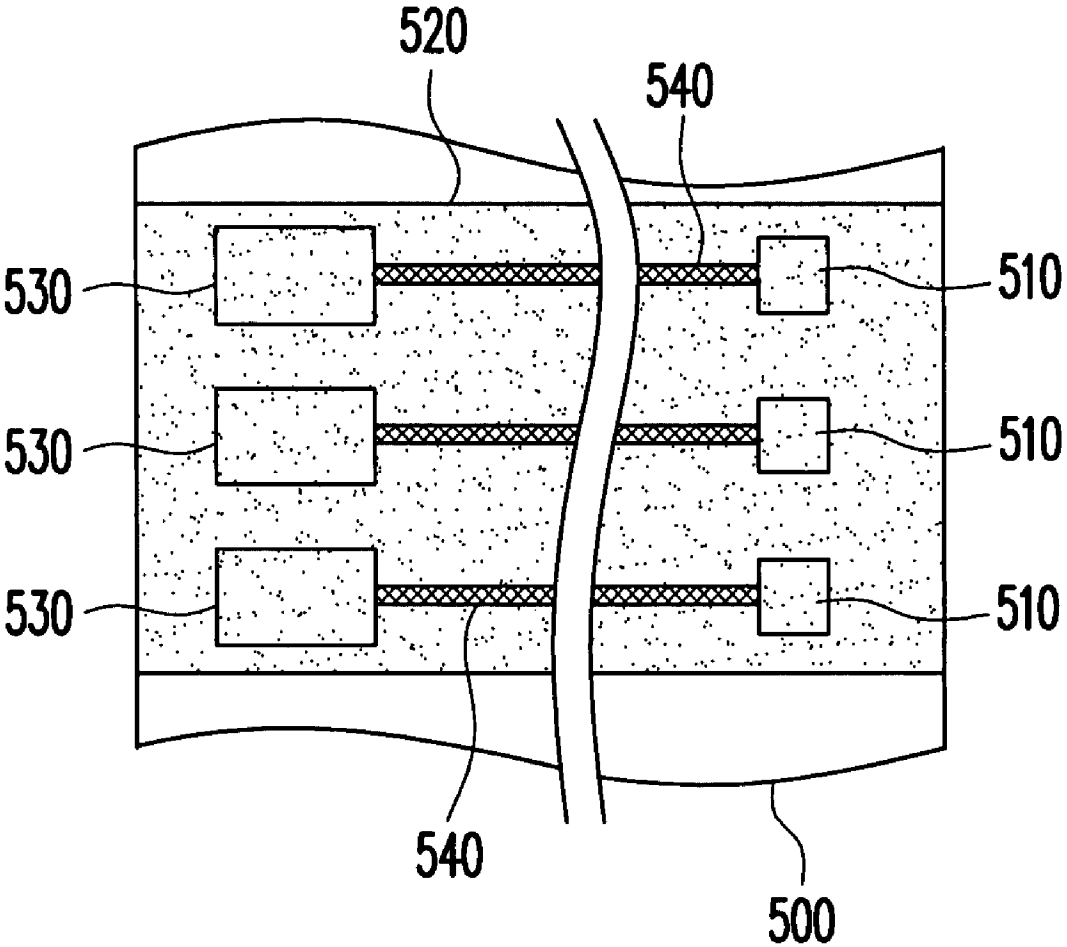
FIG. 5 is a cross-sectional view, schematically illustrating an inkjet printhead chip according to the third embodiment of the present invention.

FIG. 5 is a cross-sectional view, schematically illustrating an inkjet printhead chip according to the third embodiment of the present invention.

Please refer to FIG. 5, the inkjet printhead chip according to the embodiment includes a substrate 500, a plurality of transistor circuits 510 and a plurality of film layers 520. The transistor circuits 510 are disposed on the substrate 500, and each transistor circuit 510 includes a gate oxide layer (like layer 204 as shown in FIG. 2) with the thickness is less than 800 Å. The film layers 520 are formed on the transistor circuits 510, wherein the film layers 520 includes a resistive layer (like layer 222 as shown in FIG. 2) which forms a plurality of heating devices 530, and the heating devices 530 are electronically coupled to the corresponding transistor circuits 510. For example, the heating devices 530 can be electronically coupled to the transistor circuits 510 via the wire 540. The wire 540 can also be the one that is electrically coupled to the drain 208*b* and the heating device 226, like the first conductor section 230*a* as shown in FIG. 2. Although there are only three transistor circuits 510 and three heating devices 530 shown in FIG. 5, it is only illustrative and schematic, and as the person skilled in the art knows that, the number of the heating devices 530 in one inkjet printhead chip is usually at least 50, while the present invention is not limited to this number. A power density less than 2 GW/m$^2$ can be obtained on the heating device 530 by supplying current to the heating device 530, wherein the resistance of each heating device 530 is less than about 95 ohm. In this embodiment, the film layers 520 may comprise the dielectric layer 220 as shown in FIG. 2 or the sandwich structured dielectric layer 320 as shown in FIG. 4 having two barrier layers (like layer 325, 326 as shown in FIG. 4) and the planar layer (like layer 328 as shown in FIG. 4) disposed between the barrier layers. The respective material and thickness range can refer to the examples in the second embodiment.

In summary, the present invention has one or all of the following features:

Since the thickness, resistance and power density of the gate oxide layer are all limited in some range in the present invention, the present invention can obtain larger driving current. Additionally, the smaller layout area for a transistor can be used to obtain the same driving capability as by the conventional art. Therefore, the usable area of the inkjet printhead chip can be reduced, which in turn the manufacturing cost can be reduced.

The present invention reduces the thickness of the gate oxide layer and adopts sandwich structured dielectric layer in one embodiment, so that larger driving current can be obtained. The sandwich structured dielectric layer can maintain the flat surface of the device while preventing the impurities in the planar layer from affecting the structures disposed below and above the sandwich structured dielectric layer.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An inkjet printhead chip, comprising:

a substrate;

a plurality of transistors disposed on the substrate, wherein each of the transistors comprises:

a gate, disposed on the substrate;

a source and a drain, disposed in the substrate at two sides of the gate respectively; and a gate oxide layer, disposed between the gate and the substrate, wherein a thickness of the gate oxide layer is less than 800 Å;

a plurality of isolation structures, disposed on the substrate and isolating each transistor;

a dielectric layer, covering the transistor and the isolation structure, wherein the dielectric layer has a plurality of openings which expose the source and the drain of each transistor;

a resistive layer, disposed on the dielectric layer, wherein the resistive layer has a plurality of heating areas;

a first conductor section, disposed on the resistive layer and exposing the heating areas thereof to form heating devices, wherein a resistance of the heating devices is less than 95 ohm, and a power density is less than 2 $GW/m^2$;

a second conductor section, disposed over the dielectric layer, electronically coupled to the drain via the opening, and the second conductor section is electronically coupled to the first conductor section; and a third conductor section, disposed over the dielectric layer, and electrically coupled to the source via the opening.

2. The inkjet printhead chip as claimed in claim 1, wherein a thickness of the gate oxide layer is 50 Å-250 Å.

3. The inkjet printhead chip as claimed in claim 1, wherein a resistance of the heating devices is between 28 ohm and 32 ohm.

4. The inkjet printhead chip as claimed in claim 1, further comprising:

a passivation layer, covering the resistive layer and the first conductor section, the second conductor section and the third conductor section; and a cavitation layer, disposed on the passivation layer above the heating areas.

5. The inkjet printhead chip as claimed in claim 4, wherein the passivation layer comprises a SiN layer, a SiC layer or a stack of SiN layer and SiC layer.

6. The inkjet printhead chip as claimed in claim 4, wherein a material of the cavitation layer comprises Ta, W or Mo.

7. The inkjet printhead chip as claimed in claim 1, wherein the first conductor section and the second conductor section belong to the same conductor layer, while the third conductor section belongs to an another conductor layer.

8. The inkjet printhead chip as claimed in claim 1, wherein the second conductor section and the third conductor section belong to the same conductor layer, while the first conductor section belongs to an another conductor layer.

9. The inkjet printhead chip as claimed in claim 1, wherein the first conductor section and the third conductor section belong to the same conductor layer, while the second conductor section belongs to an another conductor layer.

10. The inkjet printhead chip as claimed in claim 1, wherein the first conductor section, the second conductor section and the third conductor section belong to different conductor layers.

11. The inkjet printhead chip as claimed in claim 1, wherein the first conductor section, the second conductor section and the third conductor section are the three sections defined by a same conductor layer.

12. The inkjet printhead chip as claimed in claim 1, wherein the resistive layer further comprises a part extending between the second conductor section and a surface of the openings of the dielectric layer.

13. The inkjet printhead chip as claimed in claim 1, wherein the resistive layer further comprises a part extending between the third conductor section and a surface of the openings of the dielectric layer.

14. The inkjet printhead chip as claimed in claim 13, wherein a length of each of the heating devices is between 20 microns and 70 microns, and a width is between 20 microns and 70 microns.

15. The inkjet printhead chip as claimed in claim 1, wherein an aspect ratio of each of the heating devices is between 0.8 and 3.0.

16. The inkjet printhead chip as claimed in claim 1, wherein a material of the first conductor section, the second conductor section and the third conductor section comprises AlCu or Au.

17. The inkjet printhead chip as claimed in claim 1, wherein a material of the resistive layer comprises TaAl, TaN or doped polysilicon.

18. The inkjet printhead chip as claimed in claim 1, wherein the isolation structure comprises a field oxide layer.

19. The inkjet printhead chip as claimed in claim 1, wherein the number of the heating devices is at least 50.

20. An inkjet printhead chip, including:

a substrate;

a plurality of transistors, wherein each of the transistors comprises:

a gate, disposed on the substrate;

a source and a drain, disposed in the substrate at two sides of the gate respectively; and a gate oxide layer, disposed between the gate and the substrate, wherein a thickness of the gate oxide layer is less than 800 Å;

a plurality of isolation structures, disposed on the substrate and isolating each of the transistors;

a sandwich structured dielectric layer, comprising two barrier layers and one planar layer disposed between the two barrier layers, and covering the transistors and the isolation structure, wherein the sandwich structured dielectric layer has a plurality of openings which expose the source and the drain of the transistors;

a resistive layer, disposed on the sandwich structured dielectric layer and having a plurality of heating areas;

a first conductor section, disposed on the resistive layer and exposing the heating areas to form heating devices;

a second conductor section, disposed over the sandwich structured dielectric layer and being electronically coupled to the drain via the opening, and the second conductor section being electronically coupled to the first conductor section; and a third conductor section, disposed over the sandwich structured dielectric layer and being electrically coupled to the source via the opening.

21. The inkjet printhead chip as claimed in claim 20, wherein a thickness of the gate oxide layer is less than 250 Å.

22. The inkjet printhead chip as claimed in claim 20, wherein a material of the planar layer of the sandwich structured dielectric layer comprises phosphosilicate glass (PSG) or borophosphosilicate glass (BPSG).

23. The inkjet printhead chip as claimed in claim 22, wherein a thickness of the planar layer is 0.09 microns-1.4 microns.

24. The inkjet printhead chip as claimed in claim 20, wherein a material of the barrier layers of the sandwich structured dielectric layer comprises plasma-enhanced oxide (PEOX) or low pressure oxide (LPOX), and a material of the planar layer comprises phosphosilicate glass (PSG) or borophosphosilicate glass (BPSG).

25. The inkjet printhead chip as claimed in claim 24, wherein a thickness of each barrier layer is 0.09 microns-0.33 microns, and a thickness of the planar layer is 0.09 microns-1.4 microns.

26. The inkjet printhead chip as claimed in claim 20, further comprising:

a passivation layer, covering the resistive layer and the first conductor section, the second conductor section and the third conductor section; and a cavitation layer, disposed on the passivation layer above the heating areas.

27. The inkjet printhead chip as claimed in claim 26, wherein the passivation layer comprises SiN layer, SiC layer or the overlay of SiN layer and SiC layer.

28. The inkjet printhead chip as claimed in claim 26, wherein a material of the cavitation layer comprises Ta, W or Mo.

29. The inkjet printhead chip as claimed in claim 20, wherein the first conductor section and the second conductor section belong to a same conductor layer, while the third conductor section belongs to an another conductor layer.

30. The inkjet printhead chip as claimed in claim 20, wherein the second conductor section and the third conductor section belong to a same conductor layer, while the first conductor section belongs to an another conductor layer.

31. The inkjet printhead chip as claimed in claim 20, wherein the first conductor section and the third conductor section belong to a same conductor layer, while the second conductor section belongs to an another conductor layer.

32. The inkjet printhead chip as claimed in claim 20, wherein the first conductor section, the second conductor section and the third conductor section belong to different conductor layers.

33. The inkjet printhead chip as claimed in claim 20, wherein the first conductor section, the second conductor section and the third conductor section are the three sections defined by a same conductor layer.

34. The inkjet printhead chip as claimed in claim 20, wherein the resistive layer further comprises a part extending between the second conductor section and the openings of the sandwich structured dielectric layer.

35. The inkjet printhead chip as claimed in claim 20, wherein the resistive layer further comprises a part disposed between the third conductor section and the openings of the sandwich structured dielectric layer.

36. The inkjet printhead chip as claimed in claim 20, wherein an aspect ratio of the heating devices is between 0.8 and 3.0.

37. The inkjet printhead chip as claimed in claim 36, wherein a length of each of the heating devices is between 20 microns and 70 microns, and a width is between 20 microns and 70 microns.

38. The inkjet printhead chip as claimed in claim 20, wherein a material of the first conductor section, the second conductor section and the third conductor section comprises AlCu or Au.

39. The inkjet printhead chip as claimed in claim 20, wherein a material of the resistive layer comprises TaAl, TaN or doped polysilicon.

40. The inkjet printhead chip as claimed in claim 20, wherein the isolation structure comprises a field oxide layer.

41. The inkjet printhead chip as claimed in claim 20, wherein the number of the heating devices is at least 50.

42. The inkjet printhead chip as claimed in claim 20, wherein a power density less than 2 $GW/m^2$ is created in the heating device when a current supplied to the heating device.

43. An inkjet printhead chip, including:

a substrate;

a plurality of transistor circuits, disposed on the substrate, and each of the transistor circuits comprises a gate oxide layer with a thickness less than 800A; and a plurality of film layers, formed on the transistor circuits, wherein the film layers comprise a resistive layer which forms a plurality of heating devices, and the heating device is electronically coupled to the corresponding transistor circuit, and a power density less than 2 $GW/m^2$ is obtained in the heating device by supplying a current to each of the heating devices, wherein a resistance of the heating devices is less than 95 ohms, wherein the film layers comprise a sandwich structured dielectric layer which comprises two barrier layers and a planar layer disposed between to two barrier layers.

44. The inkjet printhead chip as claimed in claim 43, wherein a material of the planar layer of the sandwich structured dielectric layer comprises phosphosilicate glass (PSG) or borophosphosilicate glass (BPSG).

45. The inkjet printhead chip as claimed in claim 44, wherein a thickness of the planar layer is 0.09 microns-1.4 microns.

46. The inkjet printhead chip as claimed in claim 43, wherein a material of the barrier layers of the sandwich structured dielectric layer comprises plasma-enhanced oxide (PEOX) or low pressure oxide (LPOX), and the material of the planar layer comprises phosphosilicate glass (PSG) or borophosphosilicate glass (BPSG).

47. The inkjet printhead chip as claimed in claim 46, wherein a thickness of each of the barrier layers is 0.09 microns-0.33 microns, and a thickness of the planar layer is 0.09 microns-1.4 microns.

48. An inkjet printhead chip, comprising:

a substrate;

a plurality of transistors disposed on the substrate, wherein each of the transistors comprises:

a gate, disposed on the substrate;

a source and a drain, disposed in the substrate at two sides of the gate respectively; and a gate oxide layer, disposed between the gate and the substrate, wherein a thickness of the gate oxide layer is less than 800 Å;

a plurality of isolation structures, disposed on the substrate and isolating each transistor;

a dielectric layer, covering the transistor and the isolation structure, wherein the dielectric layer has a plurality of openings which expose the source and the drain of each transistor;

a resistive layer, disposed on the dielectric layer, wherein the resistive layer has a plurality of heating areas;

a first conductor section, disposed on the resistive layer and exposing the heating areas thereof to form heating devices, wherein a power density of the heating device is less than 2 $GW/m^2$;

a second conductor section, disposed over the dielectric layer, electronically coupled to the drain via the opening, and the second conductor section is electronically coupled to the first conductor section; and a third conductor section, disposed over the dielectric layer, and electrically coupled to the source via the opening, wherein the resistive layer further comprises a part extending between the second conductor section and a portion of a surface of the openings of the dielectric layer, or extending between the third conductor section and a portion of the surface of the openings of the dielectric layer.

* * * * *